US010876813B2

(12) United States Patent
Olheiser et al.

(10) Patent No.: US 10,876,813 B2
(45) Date of Patent: Dec. 29, 2020

(54) RIFLE STOCK MOUNTING RAIL SYSTEM

(71) Applicant: CMI Enterprises Inc., Lynnwood, WA (US)

(72) Inventors: Stephen Matthew Olheiser, Lynnwood, WA (US); Colton John Olheiser, Lynnwood, WA (US); Michael Steven Huck, Everett, WA (US)

(73) Assignee: CMI ENTERPRISES INC., Lynnwood, WA (US)

( * ) Notice: Subject to any disclaimer, the term of this patent is extended or adjusted under 35 U.S.C. 154(b) by 0 days.

(21) Appl. No.: 16/800,360

(22) Filed: Feb. 25, 2020

(65) Prior Publication Data

US 2020/0278173 A1 Sep. 3, 2020

Related U.S. Application Data

(60) Provisional application No. 62/811,778, filed on Feb. 28, 2019.

(51) Int. Cl.
*F41C 23/20* (2006.01)

(52) U.S. Cl.
CPC ..... *F41C 23/20* (2013.01)

(58) Field of Classification Search
CPC ..... F41C 23/16; F41C 27/00; F41G 11/003; F41A 35/00
See application file for complete search history.

(56) References Cited

U.S. PATENT DOCUMENTS 3,830,003 A * 8/1974 Clerke ..... F41C 23/00 42/75.03
4,878,307 A * 11/1989 Singletary ..... F41G 11/003 42/124
5,074,188 A * 12/1991 Harris ..... F41A 23/08 42/94

(Continued)

OTHER PUBLICATIONS

Miller, Brady; How to Add a Bipod Picatinny Rail Mount to a Rifle; Aug. 25, 2017; https://www.gohunt.com/read/skills/how-to-add-a-bipod-picatinny-rail-mount-to-a-rifle#gs.5lc2kg (Year: 2017).*

*Primary Examiner* — Joshua E Freeman
(74) *Attorney, Agent, or Firm* — Bennet K. Langlotz; Langlotz Patent & Trademark Works, LLC

(57) ABSTRACT

Rifle stock mounting rail systems have an elongated rail having opposed forward and rear ends, the elongated rail having an accessory mounting facility defining a plurality of mounting locations, the elongated rail defining a forward mounting aperture proximate to the forward end, the elongated rail defining a rear mounting aperture proximate to the rear end, the forward mounting aperture being configured to receive a first fastener in a stock aperture associated with a sling stud, the rear mounting aperture being configured to receive a second fastener in a stock aperture associated with a trigger guard, and the forward and rear mounting apertures being spaced apart by a distance based on a spacing between a sling stud and the second fastener. The accessory mounting facility may be an elongated channel. The accessory mounting facility may have a multitude or an unlimited number of mounting locations.

13 Claims, 8 Drawing Sheets

(56) References Cited

U.S. PATENT DOCUMENTS

| | | | | |
|---|---|---|---|---|
| 7,770,320 | B1 * | 8/2010 | Bartak | F41A 23/08 42/94 |
| 9,574,840 | B1 * | 2/2017 | Sisk | F41C 23/16 |
| 2010/0205845 | A1 * | 8/2010 | Bartak | F41A 23/08 42/71.01 |
| 2011/0131859 | A1 * | 6/2011 | Lawson | F41G 11/004 42/90 |
| 2011/0225865 | A1 * | 9/2011 | Williams | F41C 7/02 42/90 |
| 2013/0118051 | A1 * | 5/2013 | Baker | F41G 11/003 42/90 |
| 2018/0202745 | A1 * | 7/2018 | Poindextex | F41G 11/003 |

* cited by examiner

RIFLE STOCK MOUNTING RAIL SYSTEM

CROSS-REFERENCE TO RELATED APPLICATION

This application claims the benefit of U.S. Provisional Patent Application No. 62/811,778 filed on Feb. 28, 2019, entitled "A.I.M. (ACCURACY IMPROVEMENT MODIFICATION) PRECISION KIT," which is hereby incorporated by reference in its entirety for all that is taught and disclosed therein.

FIELD OF THE INVENTION

The present invention relates to firearms, and more particularly to a rifle stock mounting rail system that enables handstops, palm blocks, or bipods to be added to a rifle stock.

BACKGROUND OF THE INVENTION

Currently available rifles for target shooting are generally either inexpensive with limited functionality, or are extremely expensive with numerous customization options. There are few accessories available at relatively low cost to add functionality to an inexpensive rifle stock for target shooting to optimize the user's performance. Those accessories that exist require significant modifications to the original firearm, such as cutting and drilling holes in the existing stock or buying a replacement stock.

Therefore, a need exists for a new and improved rifle stock mounting rail system that enables handstops, palm blocks, or bipods to be added to a rifle stock without requiring modifications to the rifle stock, thereby increasing the adjustability and fit of the stock to the user and enhancing performance. In this regard, the various embodiments of the present invention substantially fulfill at least some of these needs. In this respect, the rifle stock mounting rail system according to the present invention substantially departs from the conventional concepts and designs of the prior art, and in doing so provides an apparatus primarily developed for the purpose of providing rifle stock mounting rail system that enables handstops, palm blocks, or bipods to be added to a rifle stock without requiring modifications to the rifle stock.

SUMMARY OF THE INVENTION

The present invention provides an improved rifle stock mounting rail system, and overcomes the above-mentioned disadvantages and drawbacks of the prior art. As such, the general purpose of the present invention, which will be described subsequently in greater detail, is to provide an improved rifle stock mounting rail system that has all the advantages of the prior art mentioned above.

To attain this, the preferred embodiment of the present invention essentially comprises an elongated rail molded to conform to the underside of the existing stock having opposed forward and rear ends, the elongated rail having an accessory mounting facility defining a plurality of mounting locations, the elongated rail defining a forward mounting aperture proximate to the forward end, the elongated rail defining a rear mounting aperture proximate to the rear end, the forward mounting aperture being configured to receive a first fastener in a stock aperture associated with a sling stud, the rear mounting aperture being configured to receive a second fastener in a stock aperture adjacent to a trigger guard, and the forward and rear mounting apertures being spaced apart by a distance based on a spacing between a sling stud and the second fastener. The accessory mounting facility may be an elongated channel. The accessory mounting facility may have a multitude of mounting locations. The accessory mounting facility may have an unlimited number of mounting locations. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
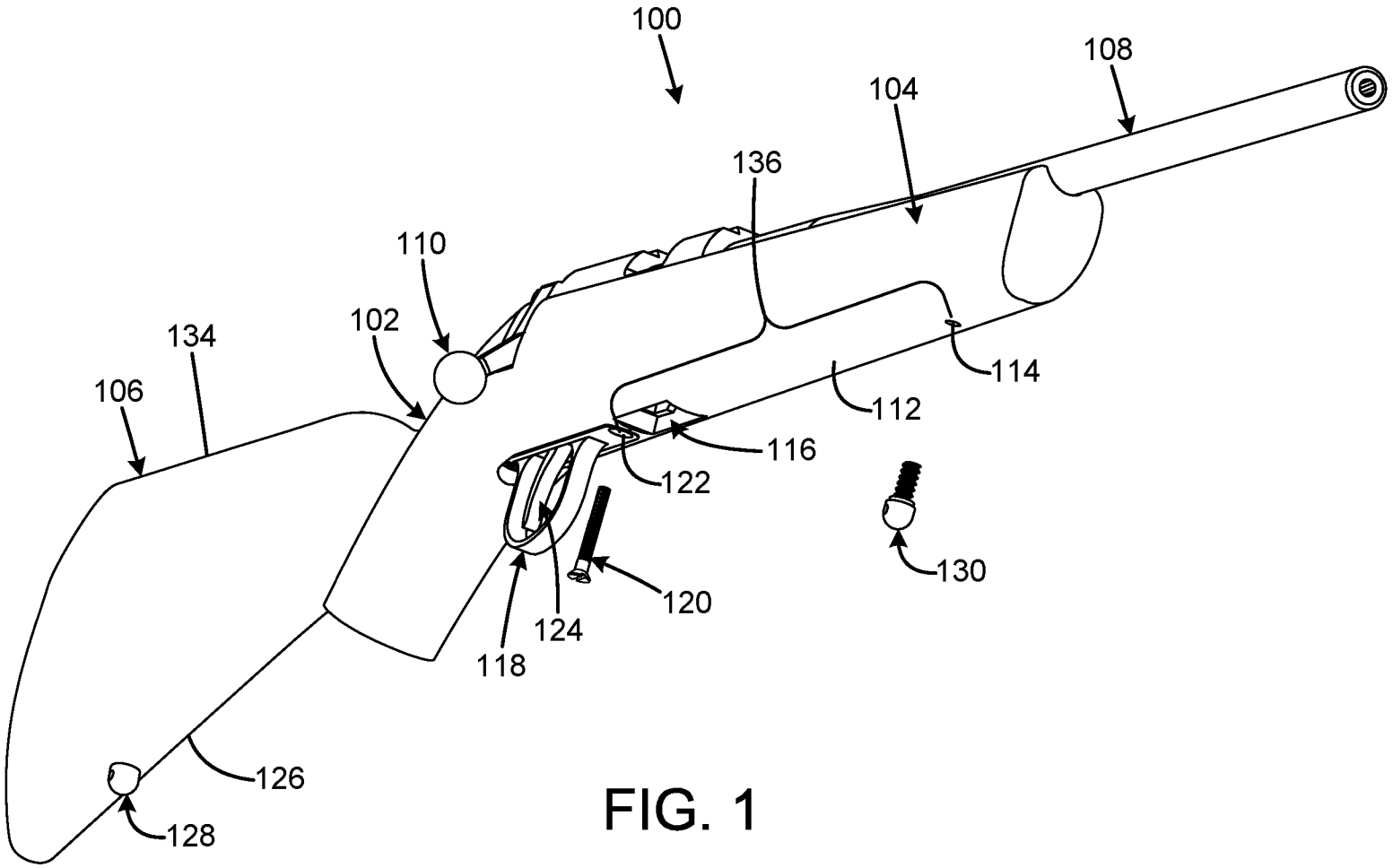
FIG. 1 is a bottom isometric exploded view of a rifle suitable for use with the current embodiment of a rifle stock mounting rail system.

An embodiment of the rifle stock mounting rail system of the present invention is shown and generally designated by the reference numeral 10.

FIG. 1 illustrates a prior art rifle 100. More particularly, the rifle is a Base Savage MK II FVT rifle manufactured by Savage Arms of Westfield, Mass. The rifle has a stock body 102 including a forend 104 and a butt stock 106. A barrel 108 is attached to the forend. A bolt handle 110 protrudes from the stock body in front of the butt stock. The forend has a lower surface 112 that defines a forward sling stud aperture 114 that threadedly receives a forward sling stud 130. The fixed position of the sling stud on the forend limits the ability of the user to adjust their hand position while still maintaining the necessary sling tension, thereby decreasing accuracy. The lower surface of the forend also defines a magazine well 116 that receives a detachable 5-round box magazine (not shown). A trigger guard 118 is attached to the lower surface of the forend and is an integrally molded part of the forend in the current embodiment. A second fastener 120 is threadedly received in an aperture 122 defined by the lower surface of the forend that is associated with the trigger guard. The second fastener conventionally serves as the rear screw of the magazine floor plate or magazine box. A trigger 124 protrudes from the lower surface of the forend and is encircled by the trigger guard.

The butt stock 106 has a lower surface 126 that defines a rear sling stud aperture 132 (shown in FIG. 3) that threadedly receives a rear sling stud 128. The butt stock also has an upper comb surface 134. The upper comb surface is a steep low comb that results in a poor cheek weld and sight alignment for the user.

Figure 2:
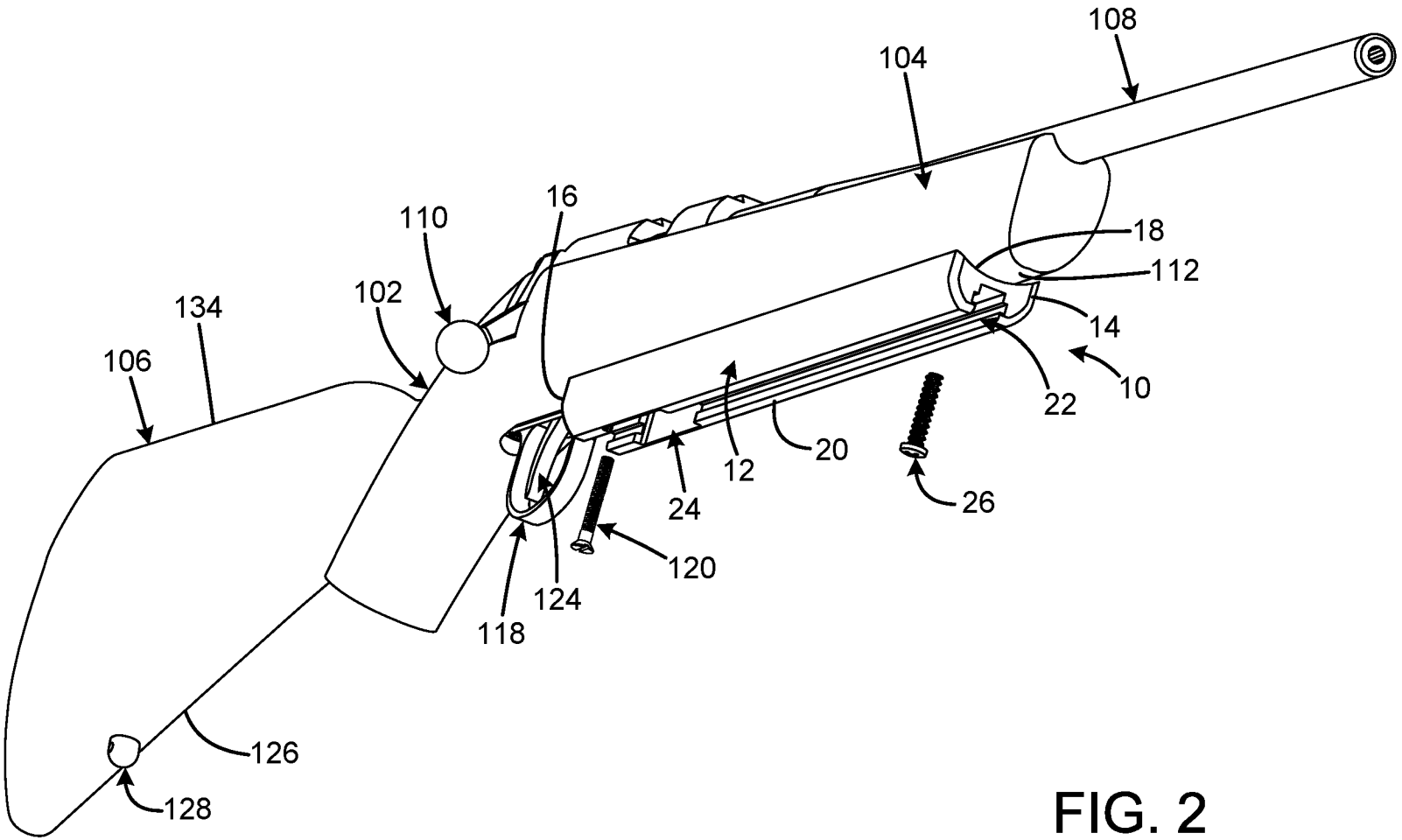
FIG. 2 is a bottom isometric exploded view of the rifle of FIG. 1 with the current embodiment of a rifle stock mounting rail system constructed in accordance with the principles of the present invention attached to the forend.
Figure 3:
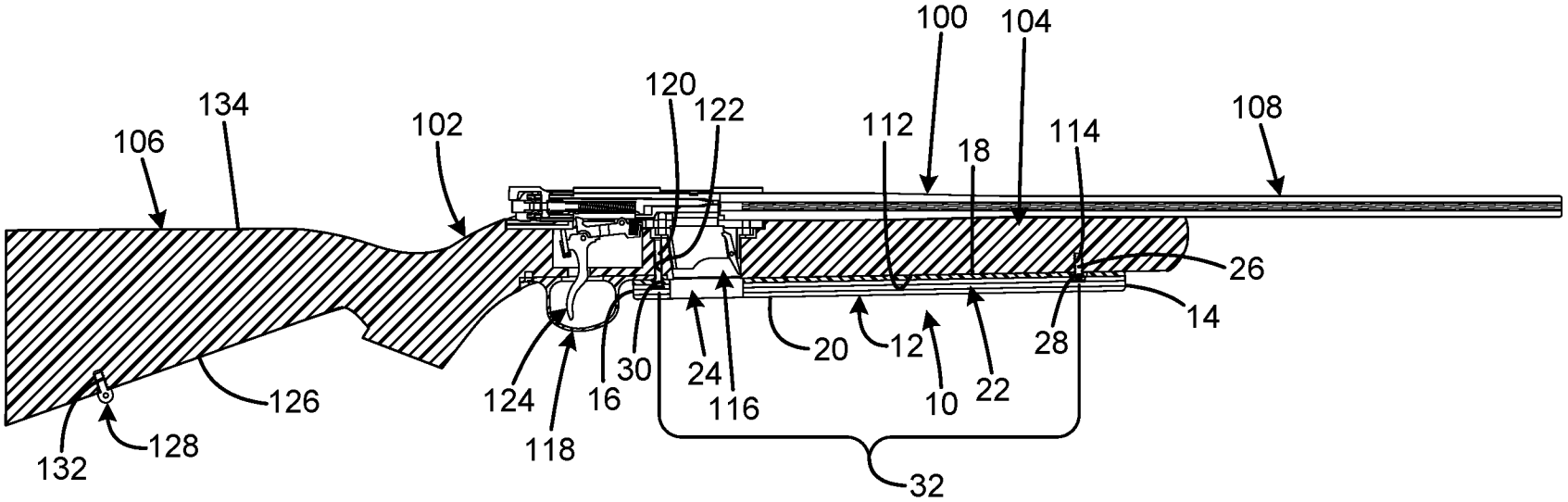
FIG. 3 is a side sectional view of the rifle of FIG. 1 with the current embodiment of a rifle stock mounting rail system constructed in accordance with the principles of the present invention attached to the forend.
Figure 4:
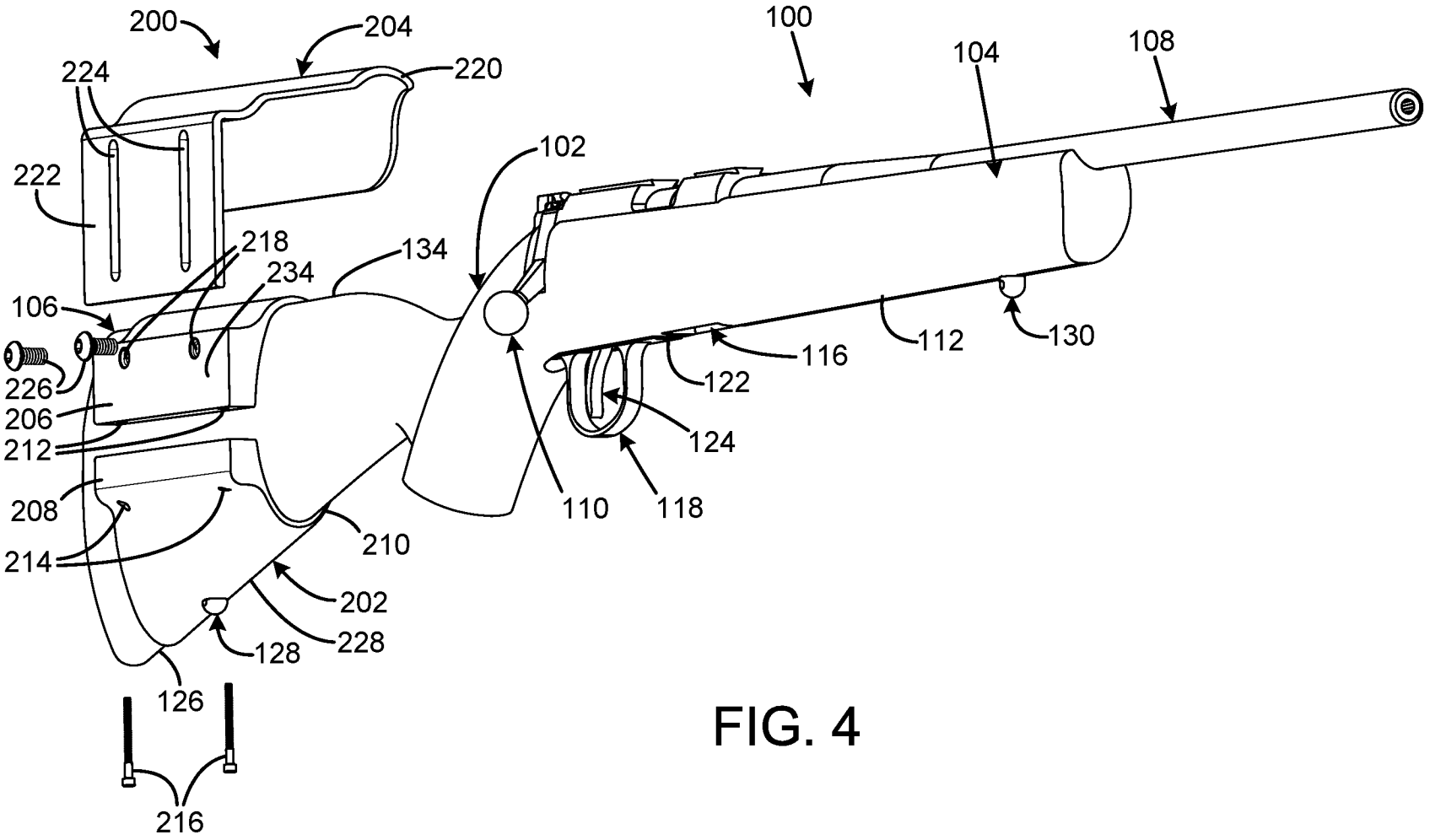
FIG. 4 is a bottom isometric exploded view of the rifle of FIG. 1 with the current embodiment of a cheek riser assembly constructed in accordance with the principles of the present invention attached to the buttstock.
Figure 5:
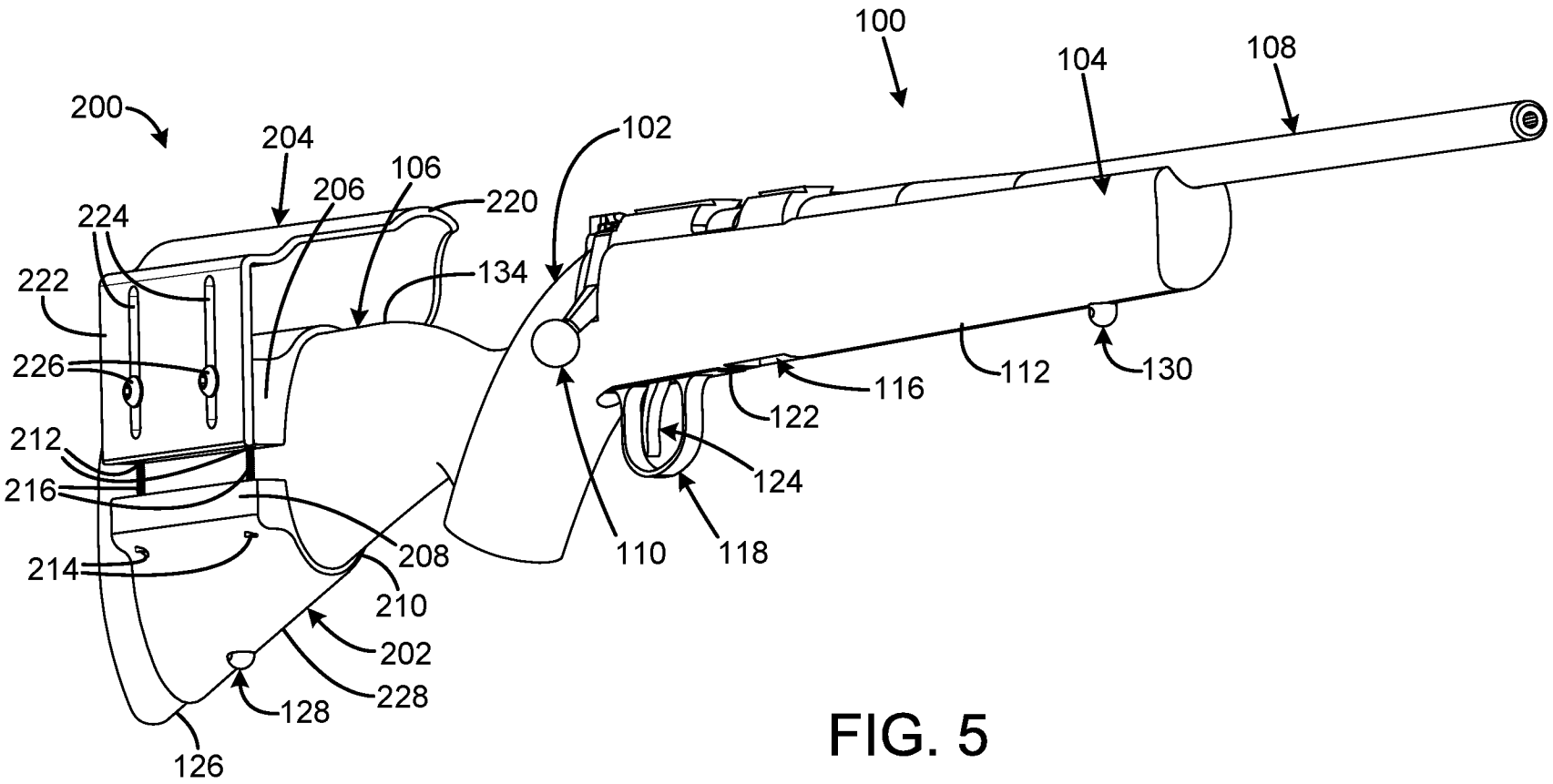
FIG. 5 is a bottom isometric view of the rifle of FIG. 1 with the current embodiment of a cheek riser assembly constructed in accordance with the principles of the present invention attached to the buttstock.
Figure 6:
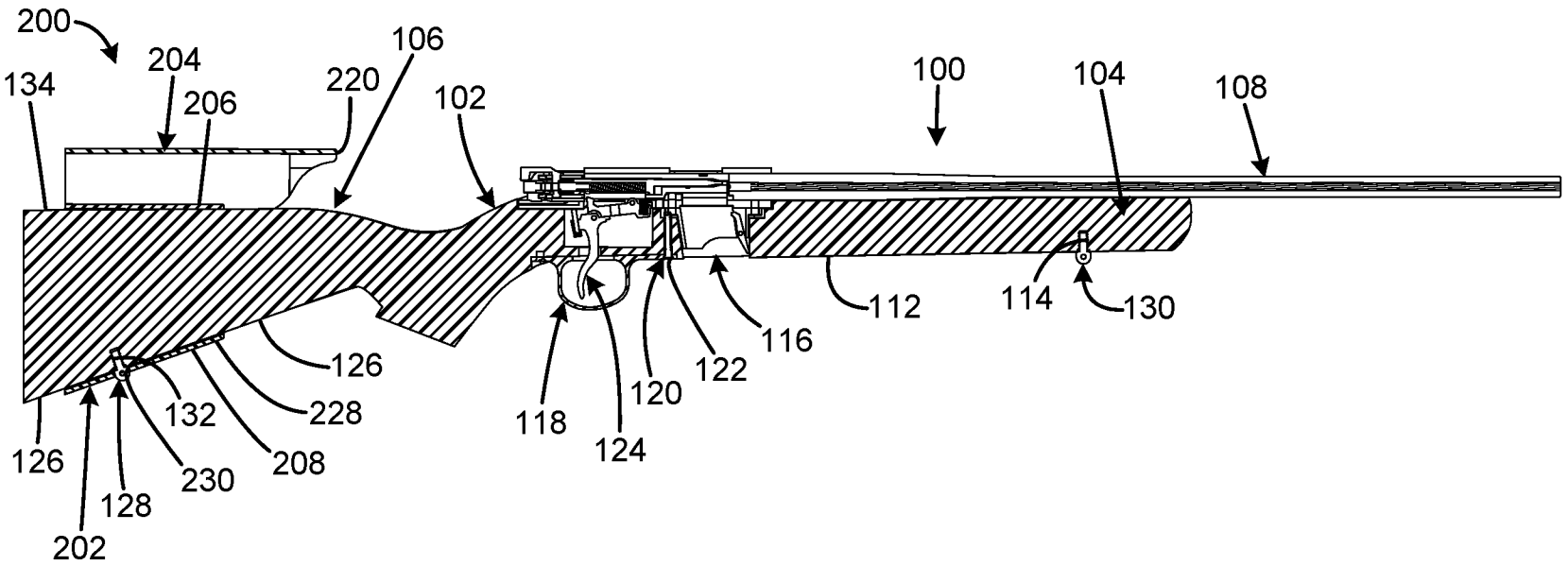
FIG. 6 is a side sectional view of the rifle of FIG. 1 with the current embodiment of a cheek riser assembly constructed in accordance with the principles of the present invention attached to the buttstock.
Figure 7:
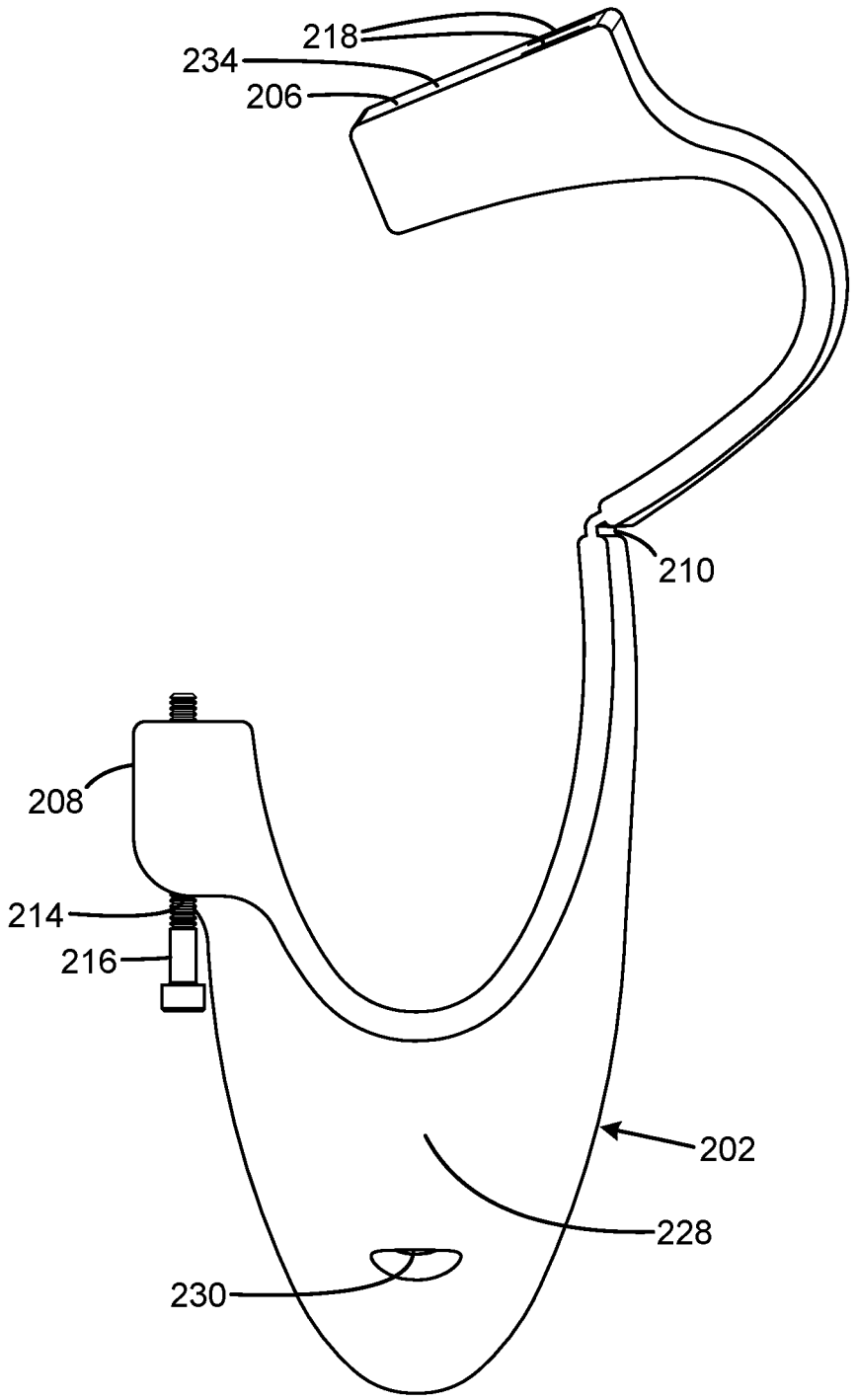
FIG. 7 is a front view of the current embodiment of the mount of the cheek riser assembly removed from the buttstock of the rifle of FIG. 1.

FIGS. 2 & 3 illustrate the improved rifle stock mounting rail system 10 of the present invention. More particularly, the rifle stock mounting rail system has an elongated rail 12 including a forward end 14, an opposed rear end 16, upper surface 18, and bottom 20. The bottom of the elongated rail defines an elongated channel 22 that extends from the forward end to the rear end. The elongated rail is molded to conform to the underside of the existing butt stock 106. The elongated rail defines a magazine passage 24 that is axially registered with the magazine well 116 on the lower surface 112 of the forend 104. The magazine passage enables the detachable 5-round box magazine (not shown) to pass through the magazine passage and be received in the magazine well on a broader range of rifles than just the Base Savage MK II FVT rifle illustrated, thereby increasing the versatility of the elongated rail. The forward end of the elongated rail is attached to the forend by a first fastener 26 received in a forward mounting aperture 28 defined by the elongated rail proximate to the forward end and threadedly received in the forward sling stud aperture 114. The rear end of the elongated rail is attached to the forend by the second fastener 120 received in a rear mounting aperture 30 proximate to the rear end and threadedly received in the aperture 122 (shown in FIG. 3).

The elongated channel 22 serves as an accessory mounting facility that has at least a plurality of mounting locations, can define a multitude of mounting locations, and preferably defines an unlimited number of mounting locations. Any suitable accessory, such as handstops, palm blocks, or bipods (not shown), can be attached to the elongated rail 12 using the elongated channel in any desired location along the elongated rail provided the magazine passage 24 is not obstructed by the accessory. The forward sling stud aperture 114 and rear sling stud aperture 132 are both stock apertures associated with a sling stud. The aperture 122 is a stock aperture associated with the second fastener 120. The forward and rear mounting apertures 28, 30 are spaced apart by a distance 32 based on a selected spacing 136 (shown in FIG. 1) between the forward sling stud 130 and the second fastener or the aperture 122. In the current embodiment, the rear mounting aperture is forward of the trigger guard 118. The upper surface 18 of the elongated rail is contoured to closely abut the lower surface 112 of the forend 104, and in the current embodiment is molded to conform to the underside of the existing stock. The elongated rail is a straight body in the current embodiment.

FIGS. 4-7 illustrate an improved cheek riser assembly 200 of the present invention. More particularly, the cheek riser assembly 200 has a mount 202 and a cheek piece 204. The mount has a top 206 and a bottom 208 that are connected by a clamshell hinge molded into the portion 210. The top defines vertical apertures 212, and the bottom defines vertical apertures 214. The vertical apertures 212, 214 are axially registered with one another when the butt stock 106 is received by the mount such that mount fasteners 216 received by vertical apertures 212, 214 create a clamping action to tightly secure the mount to the butt stock. The top of the mount also has a flat portion 234 that defines horizontal apertures 218.

The cheek piece 204 has an upper portion 220 that is contoured create a seamless fit over the top 206 of the mount 202 and the upper comb surface 134 of the butt stock 106. The cheek piece has a lower portion 222 that closely abuts the flat portion 234 of the top of the mount. The lower portion defines two height adjustment slots 224 that are aligned with the horizontal apertures 218 in the top of the mount. Two Allen head set screws 226 are received by the height adjustment slots and threadedly received by the horizontal apertures to releasably secure the cheek piece at a selected height relative to the upper comb surface. Thus, the height of the cheek piece can be adjusted to enable the user to change their head position relative to the sights (not shown) on the rifle 100.

The mount has a lower portion 228 that closely abuts the lower surface 126 of the butt stock 106. The lower portion of the mount defines an aperture 230 that is axially registered with the rear sling stud aperture 132 in the lower surface of the butt stock. The rear sling stud is threadedly received by the rear sling stud aperture. The aperture 230 is a smooth hole molded in the lower portion of the mount that slips over the rear sling stud 128 to prevent the mount from sliding forward or rearward on the butt stock. The mount has an upper portion that closely abuts the upper comb surface 134 of the butt stock. The clamshell hinge portion 210 also closely abuts the butt stock. Thus, the mount is a tapered sleeve that closely receives the tapered butt stock.

Figure 8:
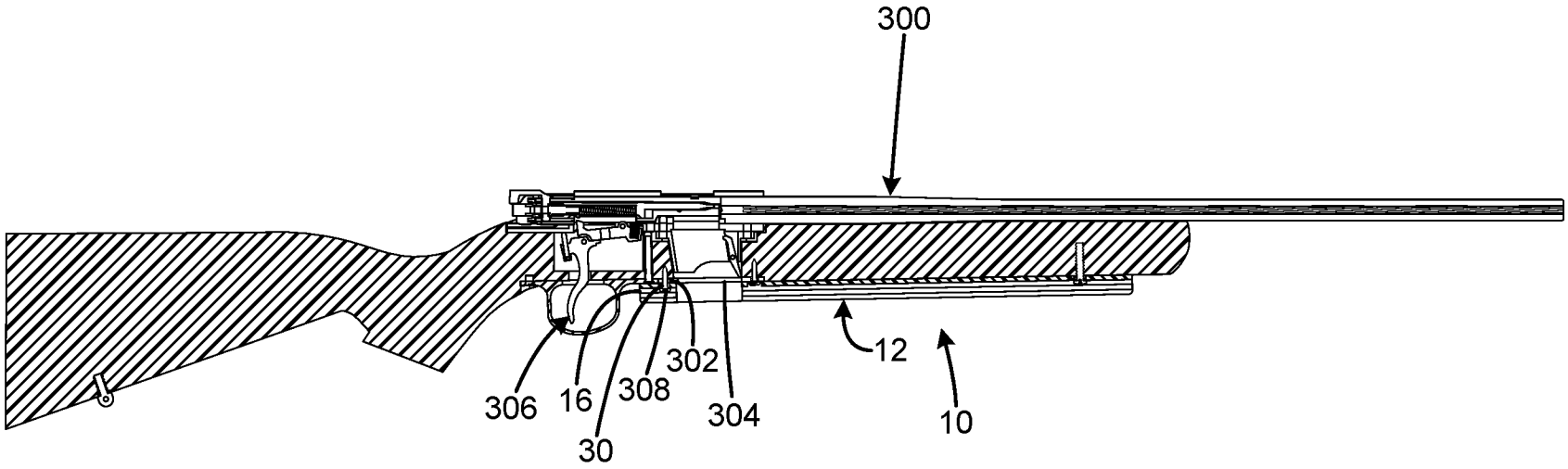
FIG. 8 is a side sectional view of an alternative embodiment of the rifle with the current embodiment of a rifle stock mounting rail system constructed in accordance with the principles of the present invention attached to the forend.

FIG. 8 illustrates the improved rifle stock mounting rail system 10 of the present invention. More particularly, the rifle stock mounting rail system is shown installed on an alternative embodiment of a rifle 300. The rifle includes a stock aperture 302 associated with a lower plate 304 and proximate to a trigger 306. The rear mounting aperture 30 in the rear end 16 of the elongated rail 12 is configured to receive a second fastener 308 that is threadedly received in the stock aperture. It should be appreciated that the hole locations for mounting fasteners and the locations of any existing screws in the rifle are specific to a particular rifle. To enable the elongated rail to be compatible with an individual rifle, additional holes can be made in the rifle to match the mounting holes in the elongated rail, or mounting holes can be made in different locations in the elongated rail to match the mounting holes in the rifle. Furthermore, clearance holes to accommodate any existing screws in the rifle can be added to the elongated rail in the necessary locations.

While a current embodiment of a rifle stock mounting rail system and a cheek riser assembly have been described in detail, it should be apparent that modifications and variations thereto are possible, all of which fall within the true spirit and scope of the invention. For example, the rifle stock mounting rail system and the cheek riser assembly are suitable for use with a variety of rifles in addition to the Base Savage MK II FVT described. Furthermore, both the rifle stock mounting rail system and the cheek riser assembly can be used alone or in combination with each other. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A rifle stock mounting rail system comprising:

a rifle stock, said rifle stock having a sling stud in a sling stud aperture and an attached plate having a plate aperture, the rifle stock defining a magazine passage, the rifle stock mounting rail further comprising an elongated rail having opposed forward and rear ends;

the elongated rail having an accessory mounting facility defining a plurality of mounting locations;

the elongated rail defining a forward mounting aperture proximate to the forward end;

the elongated rail defining a rear mounting aperture proximate to the rear end;

the elongated rail defining a magazine aperture registered with the magazine passage, the magazine aperture being forward of the rear mounting aperture and rearward of the plurality of mounting locations;

a first fastener received in the forward mounting aperture configured to replace the sling stud in the sling stud aperture of the stock;

a second fastener received in the rear mounting aperture and the plate aperture in registration with the rear mounting aperture; and the forward and rear mounting apertures being spaced apart by a distance based on a spacing between a sling stud aperture and the plate aperture.

2. The rifle stock mounting rail system of claim 1 wherein the accessory mounting facility is an elongated channel.

3. The rifle stock mounting rail system of claim 1 wherein the accessory mounting facility has a multitude of mounting locations.

4. The rifle stock mounting rail system of claim 1 wherein the accessory mounting facility has an unlimited number of mounting locations.

5. The rifle stock mounting rail system of claim 1 wherein the rear mounting aperture is forward of a trigger guard.

6. The rifle stock mounting rail system of claim 1 wherein the elongated rail has an upper surface contoured to closely abut a lower surface of a forend of a rifle stock.

7. The rifle stock mounting rail system of claim 1 wherein the elongated rail is a straight body.

8. The rifle stock mounting rail system of claim 1 wherein the plate is a part of a trigger guard.

9. The rifle stock mounting rail system of claim 8 wherein the plate aperture is a forward trigger guard screw aperture.

10. The rifle stock mounting rail system of claim 1 wherein the plate is removably connected to the stock.

11. The rifle stock mounting rail system of claim 1 wherein the plate is mounted flush with the stock.

12. The rifle stock mounting rail system of claim 1 wherein the stock defines an inlet recess receiving the plate.

13. The rifle stock mounting rail system of claim 1 wherein at least a portion of the plate is overlaid by the elongated rail.

* * * * *